US009748033B2

(12) United States Patent
Yen et al.

(10) Patent No.: US 9,748,033 B2
(45) Date of Patent: Aug. 29, 2017

(54) INTEGRATED TRANSFORMER

(71) Applicant: Realtek Semiconductor Corp., HsinChu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 208 days.

(21) Appl. No.: 14/719,297

(22) Filed: May 21, 2015

(65) Prior Publication Data

US 2015/0310981 A1 Oct. 29, 2015

Related U.S. Application Data

(63) Continuation-in-part of application No. 14/690,477, filed on Apr. 20, 2015.

(30) Foreign Application Priority Data

Apr. 23, 2014 (TW) ..... 103114707 A
Jul. 17, 2014 (TW) ..... 103124582 A

(51) Int. Cl.
*H01F 5/00* (2006.01)
*H01F 27/28* (2006.01)
*H01F 38/14* (2006.01)

(52) U.S. Cl.
CPC ..... *H01F 27/2804* (2013.01); *H01F 5/00* (2013.01); *H01F 38/14* (2013.01); *H01F 2027/2809* (2013.01)

(58) Field of Classification Search
CPC ..... H01F 5/00; H01F 27/00–27/30
USPC ..... 336/65, 200, 232
See application file for complete search history.

(56) References Cited

U.S. PATENT DOCUMENTS 4,816,784 A * 3/1989 Rabjohn ..... H01F 27/2804 333/24 R
5,420,558 A * 5/1995 Ito ..... H01F 17/0006 336/200
6,396,362 B1 * 5/2002 Mourant ..... H03H 7/42 333/25
6,559,751 B2 * 5/2003 Liu ..... H01L 27/08 257/E27.046
7,253,712 B1 * 8/2007 Papananos ..... H01F 27/2804 336/200
7,956,713 B2 6/2011 Chandrasekhar et al.
(Continued)

*Primary Examiner* — Tuyen Nguyen
(74) *Attorney, Agent, or Firm* — Winston Hsu

(57) ABSTRACT

An integrated transformer includes a primary inductor and a secondary inductor wherein the primary inductor includes a B turns spiral winding formed by a first metal layer and an A turns winding formed by a second metal layer, wherein the A turns winding formed by the second metal layer and the innermost turns of the B turns spiral winding formed by the first metal layer are substantially overlapped; and the secondary inductor includes a C turns winding at least formed by the second metal layer, wherein the C turns winding formed by the second metal layer of the secondary inductor and a portion of the winding formed by the first metal layer of the primary inductor are substantially overlapped, wherein A is not bigger than B, and A is not bigger than C.

14 Claims, 14 Drawing Sheets

(56) References Cited

U.S. PATENT DOCUMENTS

| | | | | |
|---|---|---|---|---|
| 8,581,684 | B2 * | 11/2013 | Noire | H01F 17/0013 336/200 |
| 2007/0247269 | A1 | 10/2007 | Papananos | |
| 2012/0268229 | A1 | 10/2012 | Yen et al. | |

* cited by examiner

INTEGRATED TRANSFORMER

CROSS REFERENCE TO RELATED APPLICATIONS

This is a continuation-in-part application of co-pending U.S. application Ser. No. 14/690,477, filed on Apr. 20, 2015, the contents of which are incorporated herein by reference.

BACKGROUND OF THE INVENTION

1. Field of the Invention

The present invention relates to an integrated transformer, and more particularly, to an asymmetric integrated transformer.

2. Description of the Prior Art

A transformer and balun are essential elements in a radio frequency integrated circuit for implementing single end to differential conversion, signal coupling, and impedance matching. With integrated circuits developing toward system on chip (SOC), an integrated transformer/balun is gradually replacing traditional discrete elements. The passive elements in an integrated circuit such as inductors and transformers take up a lot of the chip area. How to reduce the amount of passive elements in an integrated circuit to minimize the area occupied by said passive elements while maximizing the specification of the quality factor Q and coupling coefficient K is an important issue.

SUMMARY OF THE INVENTION

One of the objectives of the present invention is to provide an integrated transformer which has good quality factor and coupling coefficient and only needs a small area for implementation of passive elements, to reduce the manufacturing costs of chip and optimize the elements' specification.

According to an embodiment of the present invention, an integrated transformer comprises a primary inductor and a secondary inductor wherein the primary inductor comprises a B turns spiral winding formed by a first metal layer and an A turns winding formed by a second metal layer, wherein the A turns winding formed by the second metal layer and the innermost turns of the B turns spiral winding formed by the first metal layer are substantially overlapped; the secondary inductor comprises a C turns winding at least formed by the second metal layer, wherein the C turns winding formed by the second metal layer of the secondary inductor and a portion of windings formed by the first metal layer of the primary inductor are substantially overlapped, wherein A is not bigger than B, and A is not bigger than C.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
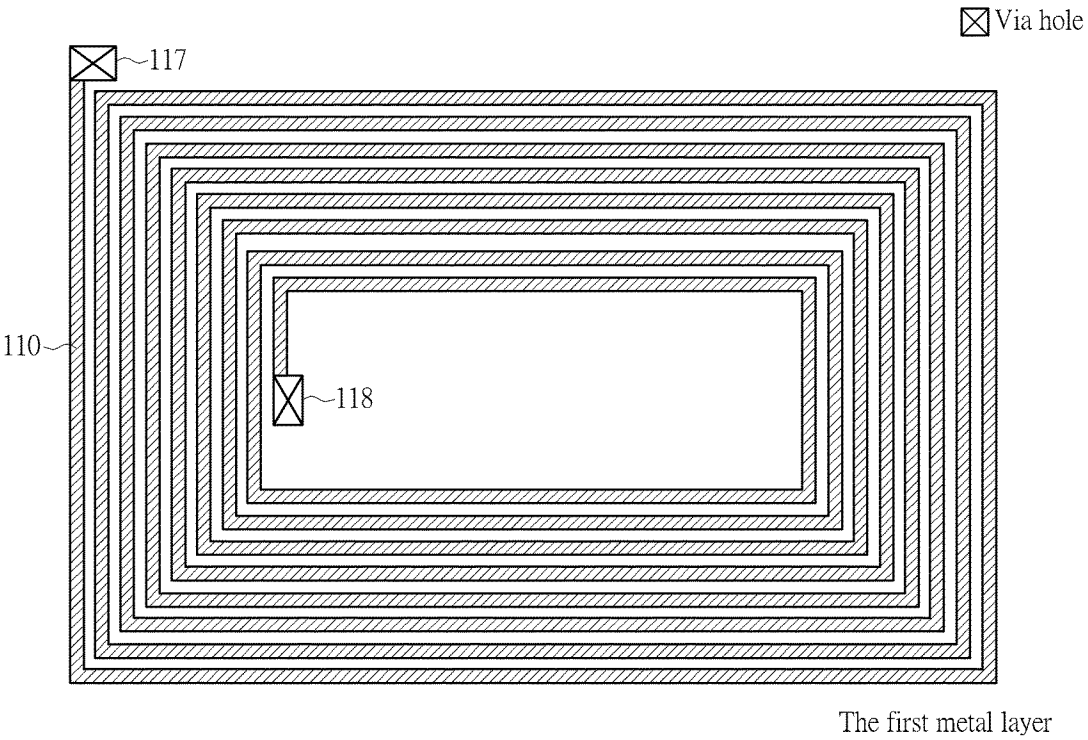
FIG. 1A is a diagram illustrating the pattern of a first metal layer of an integrated transformer according to a first embodiment of the present invention.
Figure 1B:
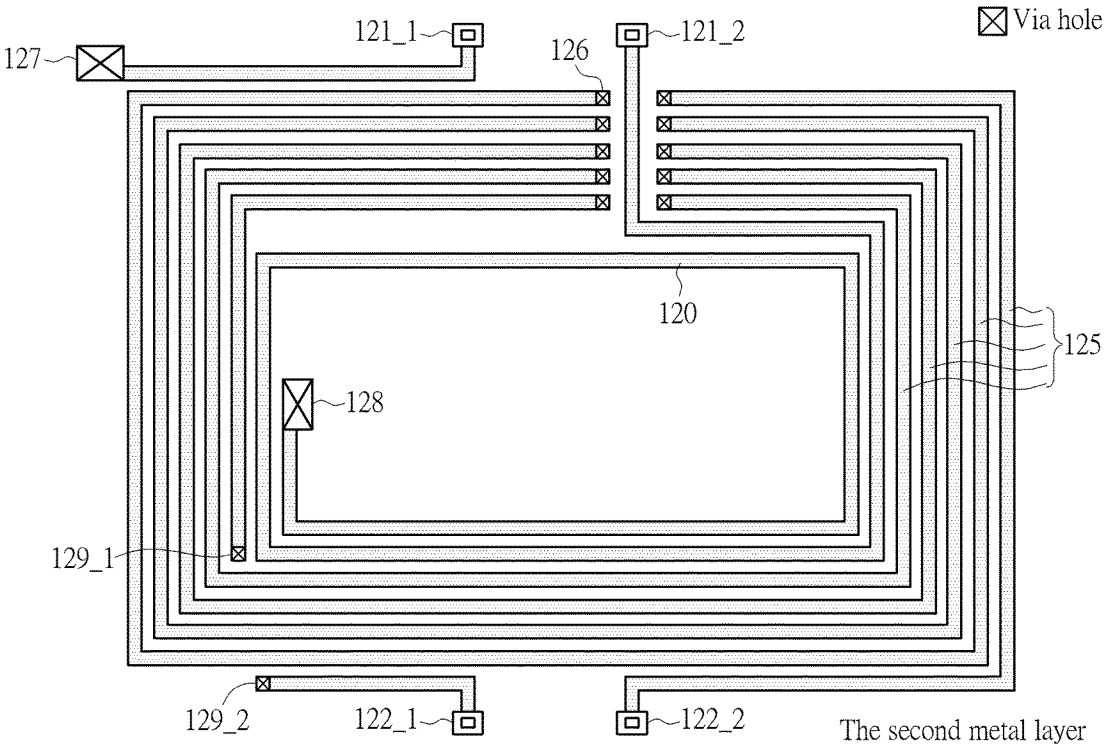
FIG. 1B is a diagram illustrating the pattern of a second metal layer of the integrated transformer according to the first embodiment of the present invention.
Figure 1C:
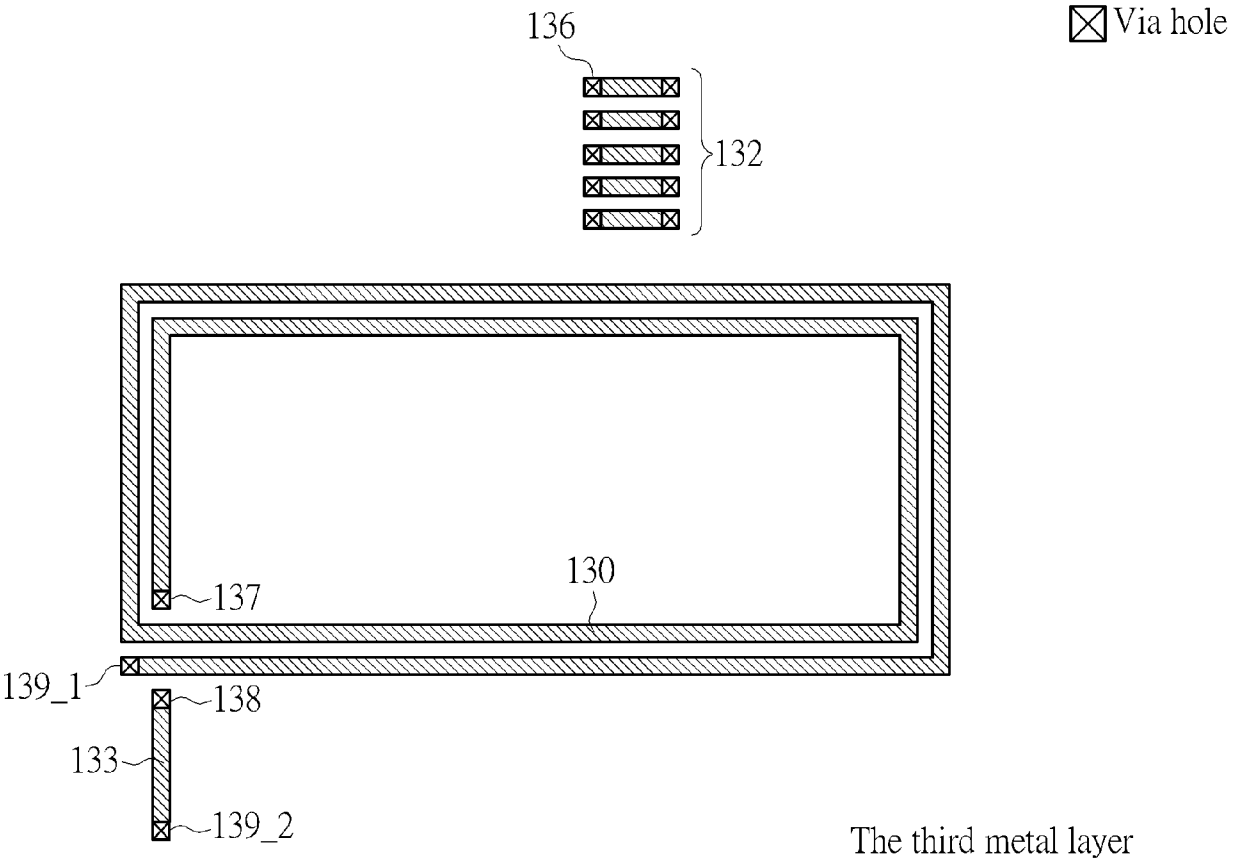
FIG. 1C is a diagram illustrating the pattern of a third metal layer of the integrated transformer according to the first embodiment of the present invention.
Figure 1D:
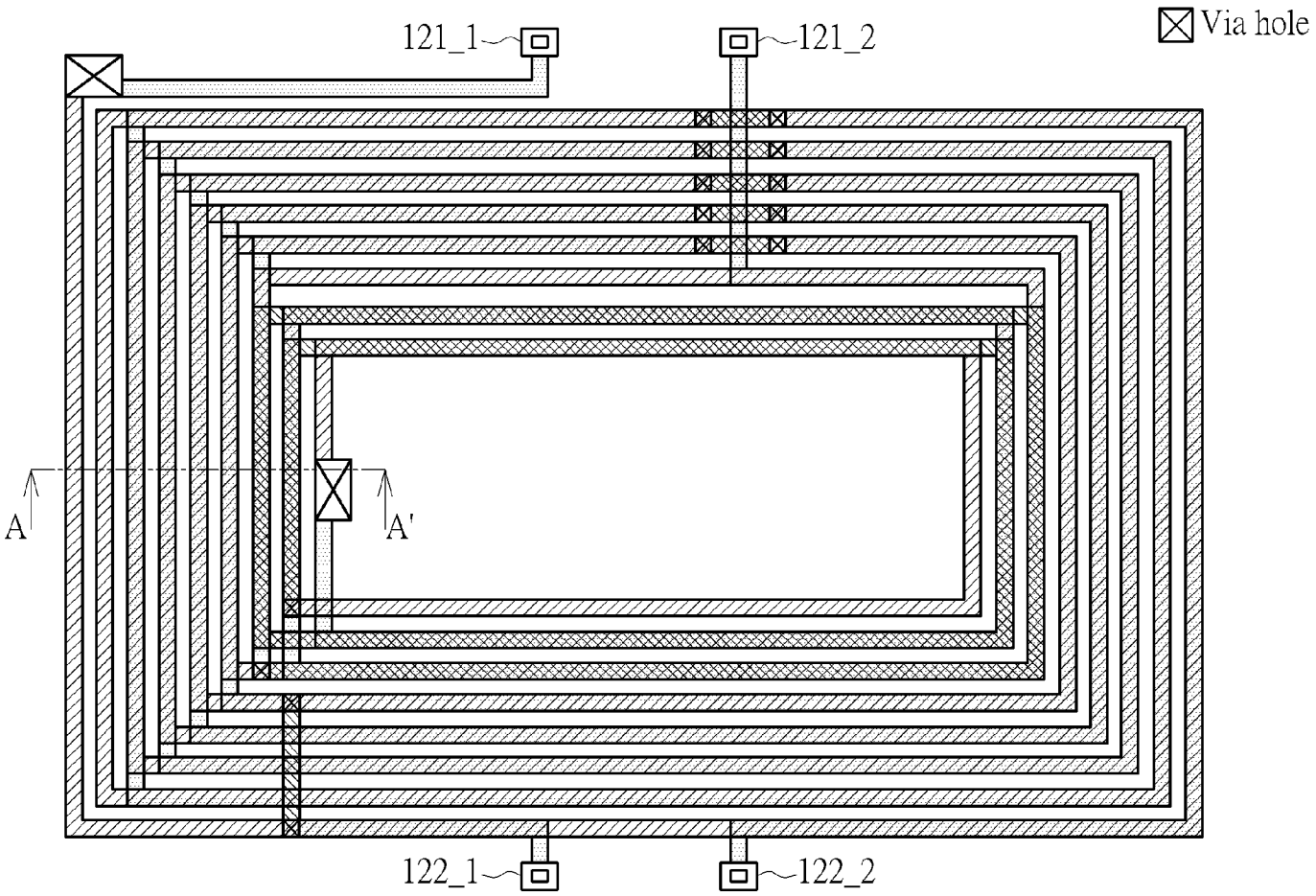
FIG. 1D is a diagram illustrating a top view of the integrated transformer according to the first embodiment of the present invention.
Figure 1E:
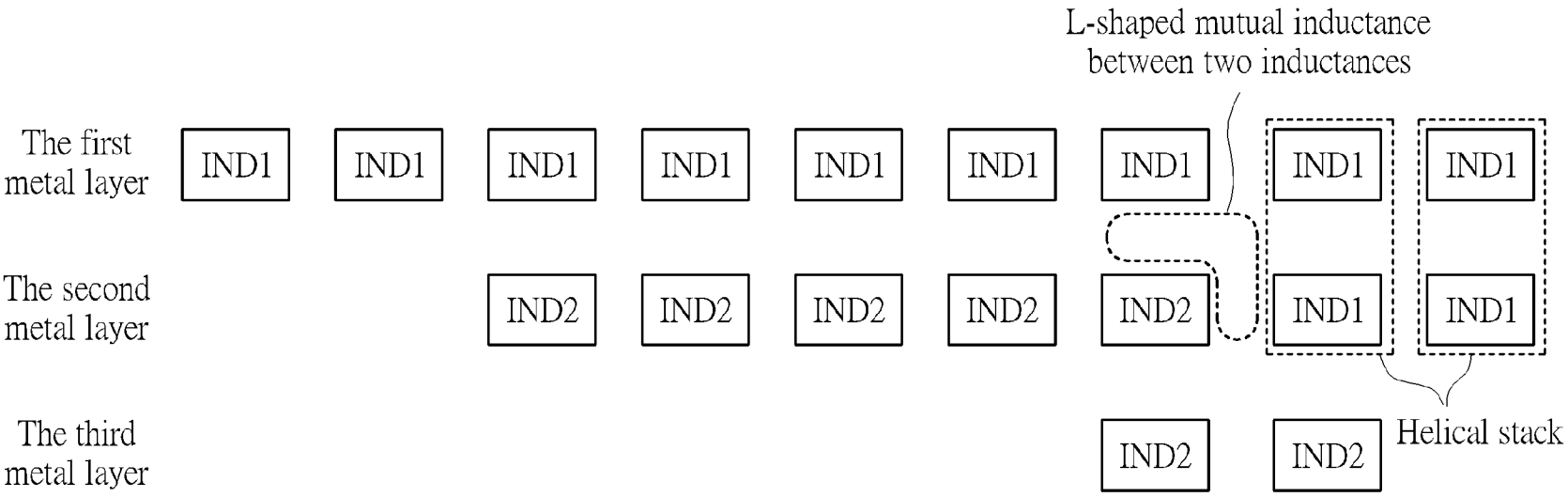
FIG. 1E is a diagram illustrating a cross-sectional view of the integrated transformer according to the first embodiment of the present invention.

Refer to FIG. 1A, FIG. 1B, FIG. 1C, FIG. 1D and FIG. 1E, wherein FIG. 1A, FIG. 1B and FIG. 1C are diagrams illustrating the patterns of a first metal layer, a second metal layer and a third metal layer of an integrated transformer according to a first embodiment of the present invention, FIG. 1D is a diagram illustrating a top view of the integrated transformer according to the first embodiment of the present invention, and FIG. 1E is a diagram illustrating a cross-sectional view of this embodiment. The integrated transformer in this embodiment can be a transformer or a balun in radio frequency integrated circuit.

In this embodiment, the integrated transformer is an asymmetric integrated transformer, wherein the proportion of the two inductances is 9 nH:6 nH (nano-Henry), and the whole integrated transformer occupies a small area of about 150 um*100 um (micro-meter). These figures are given as an example, and not a limitation, of the present invention.

In this embodiment, the first metal layer is a Re-Distribution Layer (RDL), and the second metal layer is an Ultra-Thick Metal (UTM), and the second metal layer is disposed between the first metal layer and the third metal layer. This is not a limitation of the present invention; in other embodiments, the first metal layer and the second metal layer can be any two adjacent metal layers.

Referring to FIG. 1A, FIG. 1B and FIG. 1C, it is illustrated that the integrated transformer is mainly formed by a primary inductor and a second inductor formed by the first metal layer, the second metal layer and the third metal layer, wherein the primary inductor is electrically isolated from the secondary inductor. The pattern of the first metal layer comprises a spiral winding 110 and two via holes 117 and 118, and the spiral winding 110 in this embodiment has 8 or 9 turns; the pattern of the second metal layer comprises two input nodes 121_1 and 121_2 of the primary inductor, two input nodes 122_1 and 122_2 of the secondary inductor, spiral windings 120 and 125 and a plurality of via holes 126, 127, 128, 129_1 and 129_2; and the third metal layer comprises a spiral winding 130, a plurality of bridges 132 and 133 and a plurality of via holes 136, 137, 138, 139_1 and 139_2. The via holes in FIG. 1A, FIG. 1B and FIG. 1C are arranged to electrically connect two different metal layers. For example, the via hole 118 of the first metal layer is electrically connected to the via hole 128 of the second metal layer, and the via hole 129_1 of the second metal layer is electrically connected to the via hole 139_1 of the third metal layer.

In this embodiment, the primary inductor comprises a B turns spiral winding 110 formed by the first metal layer and an A turns spiral winding 120 formed by the second metal layer. In the embodiments of FIG. 1A and FIG. 1B, B is 8 or 9 and A is 1 or 2. More specifically, the two input nodes 121_1 and 121_2 of the primary inductor are both disposed in the second metal layer, and the spiral winding 110 formed by the first metal layer is connected in series with the spiral winding 120 formed by the second metal layer via the via holes 118 and 128 to form the primary inductor. In addition, the primary inductor comprises two sets of via holes 117, 127 and 118, 128 in this embodiment.

In this embodiment, the secondary inductor comprises a C turns spiral winding 125 formed by the second metal layer and a P turns spiral winding formed by the third metal layer. In the embodiments of FIG. 1B and FIG. 1C, C is 4 or 5, and P is 2. More specifically, the two input nodes 122_1 and 122_2 of the secondary inductor are both disposed in the second metal layer, the input node 122_2 is directly connected to the spiral winding 125, and the spiral winding 125 formed by the second metal layer is connected in series with the spiral winding 130 formed by the third metal layer via the via holes 129_1 and 139_1. The spiral winding 130 is connected to the bridge 133 and the input node 122_1 via a bridge formed by the fourth metal layer (not depicted) between the via holes 137 and 138 to form the secondary inductor.

The top view of FIG. 1D shows that, in the primary inductor, the spiral winding 120 formed by the second metal layer and the innermost turn of the spiral winding 110 formed by the first metal layer are substantially overlapped; and in the secondary inductor, the spiral winding 125 formed by the second metal layer and a portion of windings formed by the first metal layer of the primary inductor are substantially overlapped, and the innermost turn of the secondary inductor is directly next to the outermost turn of the spiral winding 120 formed by the second metal layer of the primary inductor.

In the cross-sectional view of A-A' of FIG. 1D, illustrated in FIG. 1E, IND1 means the primary inductor, and IND2 means the secondary inductor. In the innermost two turns of the cross-sectional view of A-A', the primary inductor forms a helical stack structure, and the primary inductor and the second inductor form an L-shaped mutual inductance between two inductances. In this plots, there are two L-shaped mutual inductance coupled together by three metal layers. This can improve the quality factor Q of the integrated transformer, enhance the coupling quantity, and reduce the used area. The mutual inductance between the primary inductor and the secondary inductor comprises the vertical coupling, the diagonal coupling and the horizontal coupling in a short distance. In other words, the primary inductor and the secondary inductor form a mutual inductor by the vertical coupling, the diagonal coupling and the horizontal coupling in a short distance.

In the integrated transformer described in the abovementioned embodiment, because the primary inductor and the secondary inductor both use spiral winding formed by two different series metal layers, the primary inductor and the secondary inductor can have maximum inductance in a smallest chip area. In addition, the integrated transformer in this embodiment has good quality factor and coupling quantity, so manufacturing costs can be reduced while optimizing the element specification.

The designs of part of the integrated transformer as depicted in FIG. 1A to FIG. 1E are only an example, and not a limitation of the present invention. More specifically, the spiral windings 120 and 130 do not need to be spiral winding, and the turns of the primary inductor and the secondary inductor can be changed in response to practical requirements. In addition, the spiral winding 130 in FIG. 1C is mainly arranged to provide extra inductance and coupling quantity to the secondary inductor. In another embodiment of the present invention, the spiral winding 130 in FIG. 1C can be removed from the integrated transformer.

Although in the embodiments in FIG. 1A to FIG. 1E the primary inductor and the secondary inductor do not comprise any parallel connection structure, for other reasons such as improving the quality factor or providing available space in the integrated transformer, one or more extra metal layers may be used to form a stack structure. For example, the third metal layer or other metal layers may be used to form a plurality of segments to connect with a portion of windings of the primary inductor or secondary inductor in parallel. These alternative designs also fall within the scope of this invention.

Figure 2A:
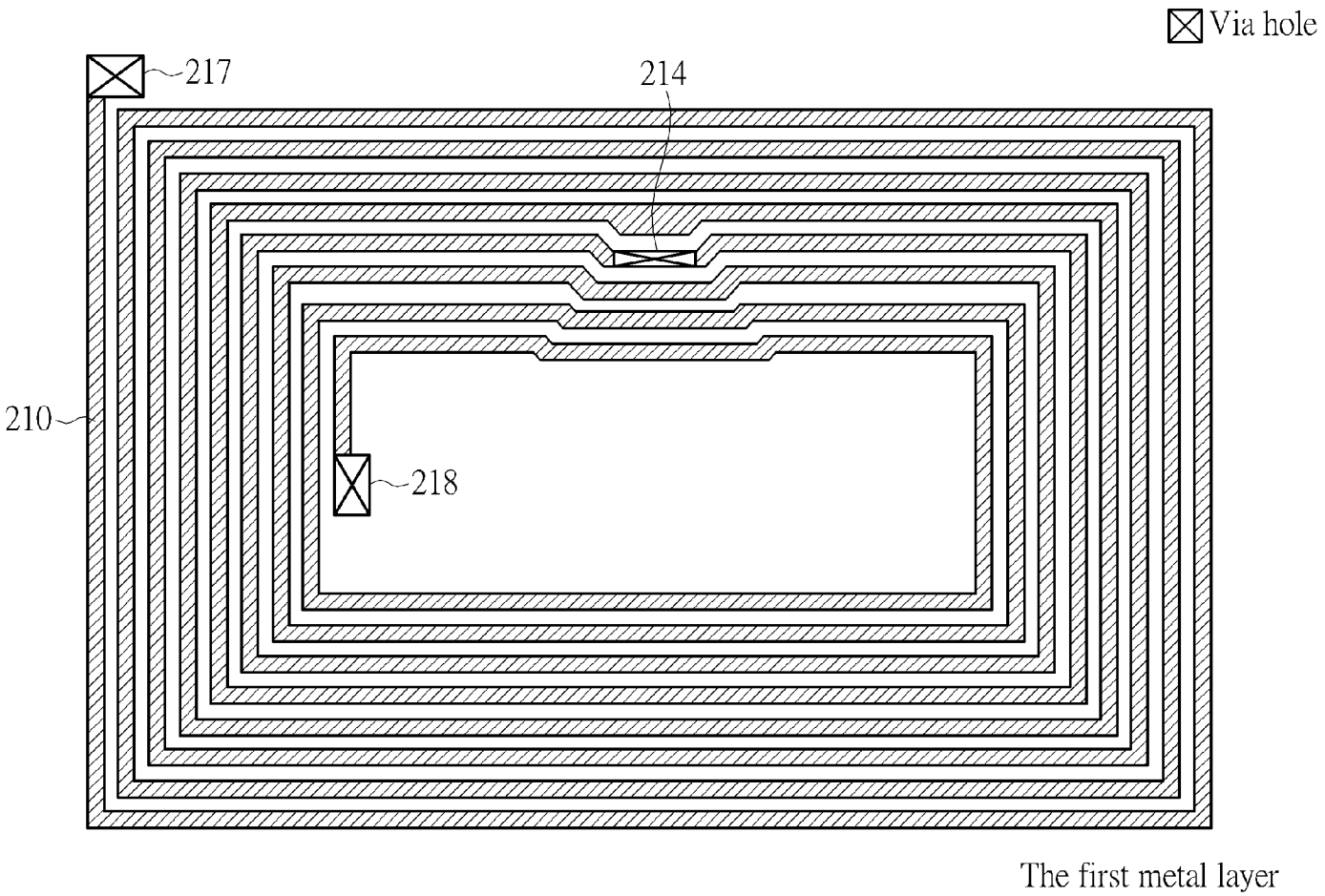
FIG. 2A is a diagram illustrating the pattern of a first metal layer of an integrated transformer according to a second embodiment of the present invention.
Figure 2B:
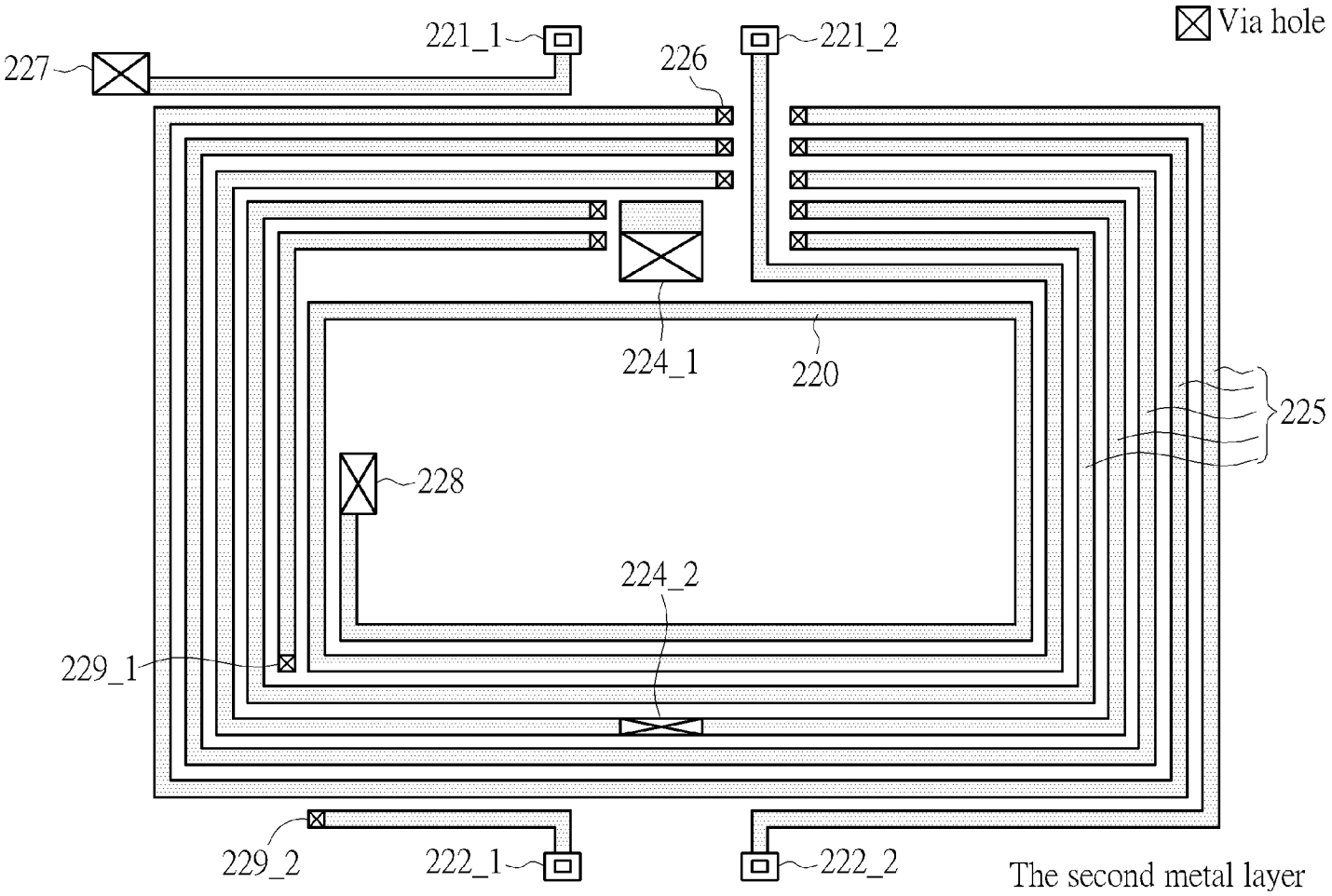
FIG. 2B is a diagram illustrating the pattern of a second metal layer of the integrated transformer according to the second embodiment of the present invention.
Figure 2C:
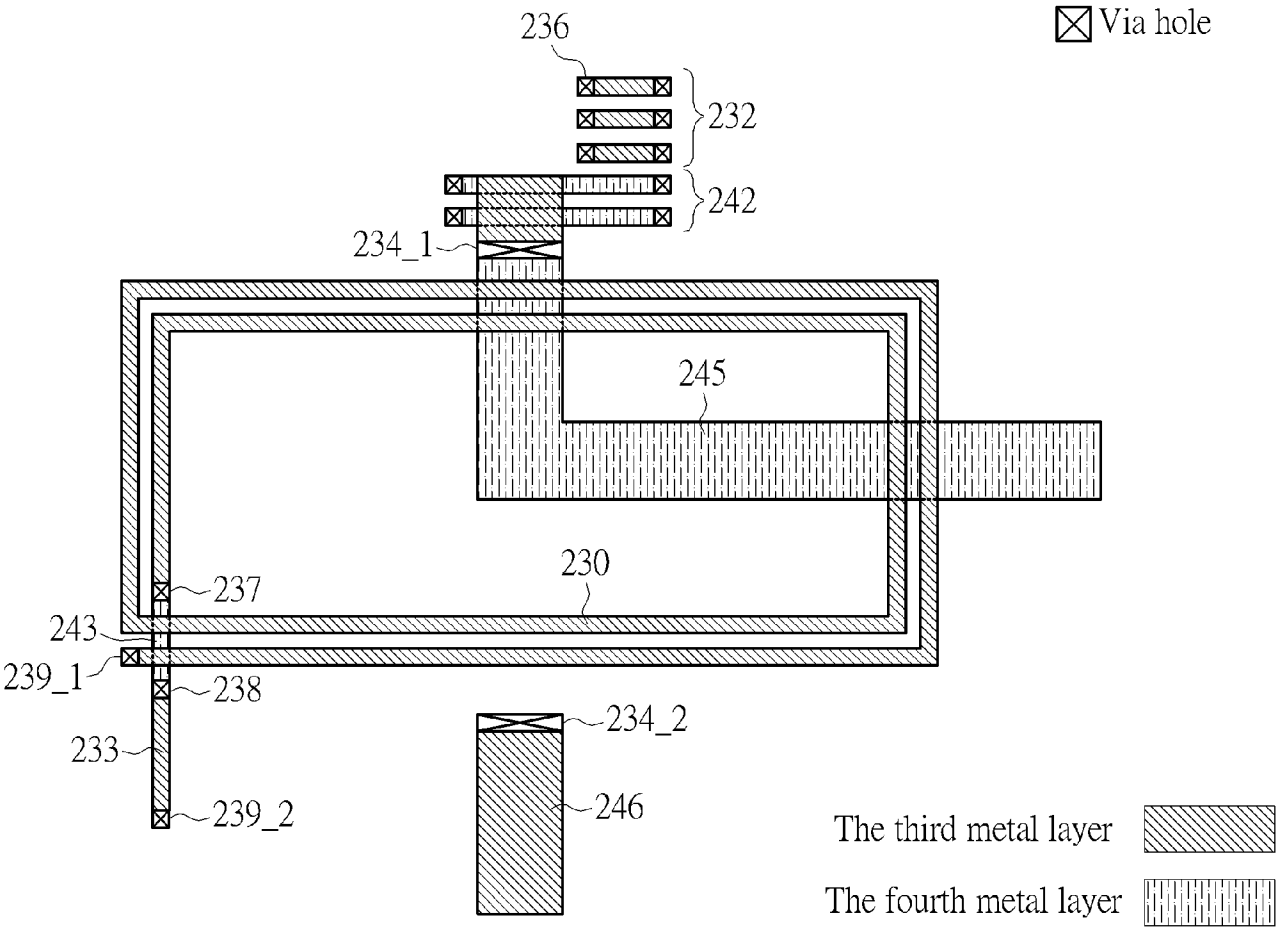
FIG. 2C is a diagram illustrating the pattern of a third metal layer and a fourth metal layer of the integrated transformer according to the second embodiment of the present invention.
Figure 2D:
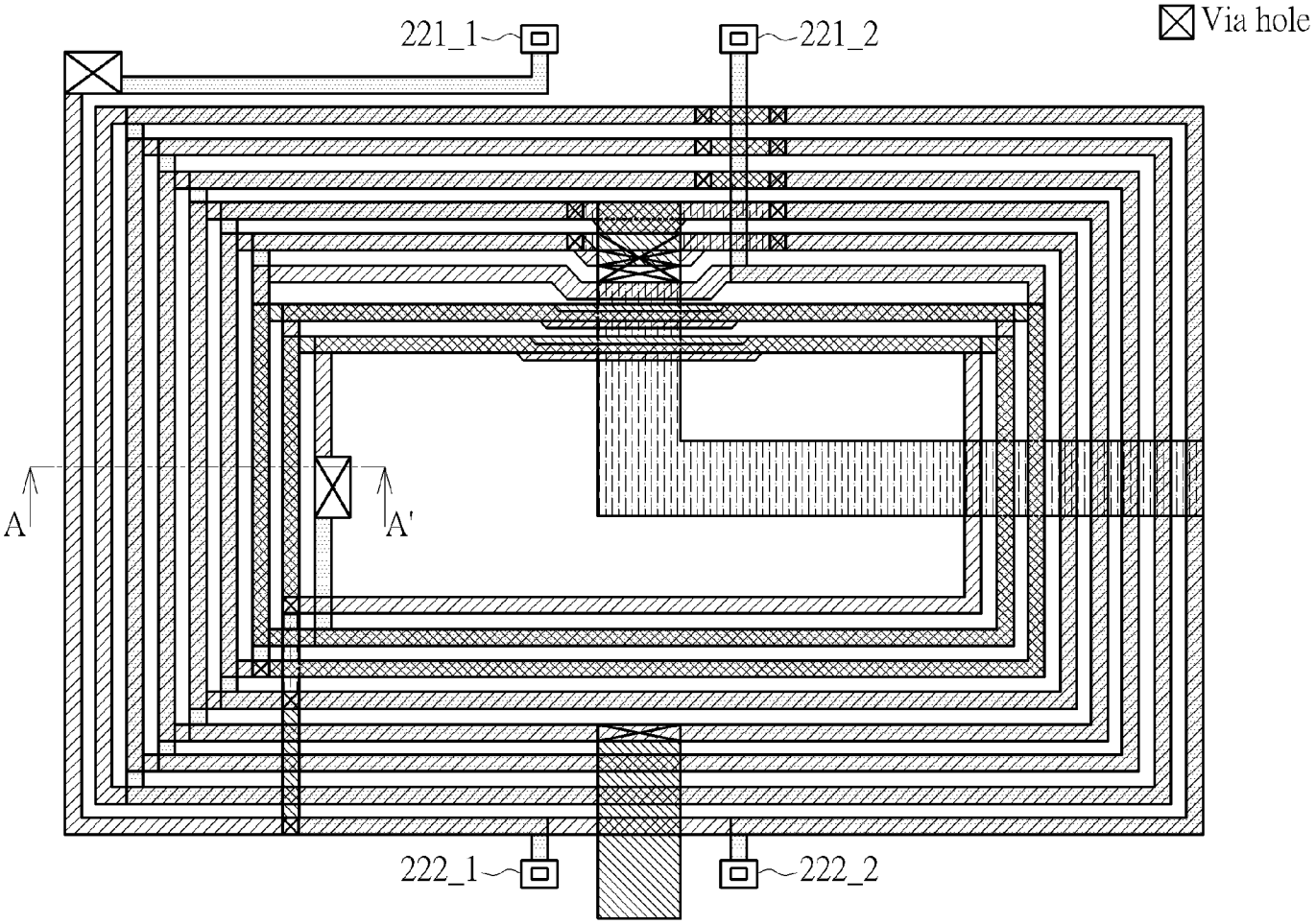
FIG. 2D is a diagram illustrating a top view of the integrated transformer according to the second embodiment of the present invention.
Figure 2E:
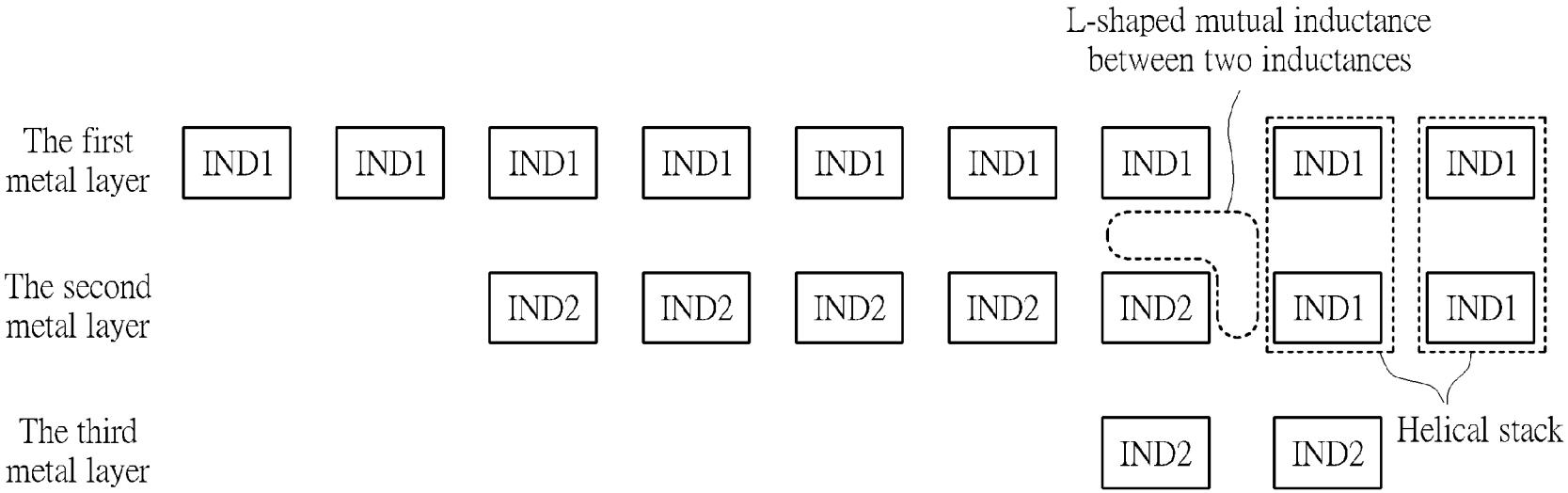
FIG. 2E is a diagram illustrating a cross-sectional view of the integrated transformer according to the second embodiment of the present invention.
Figure 3:
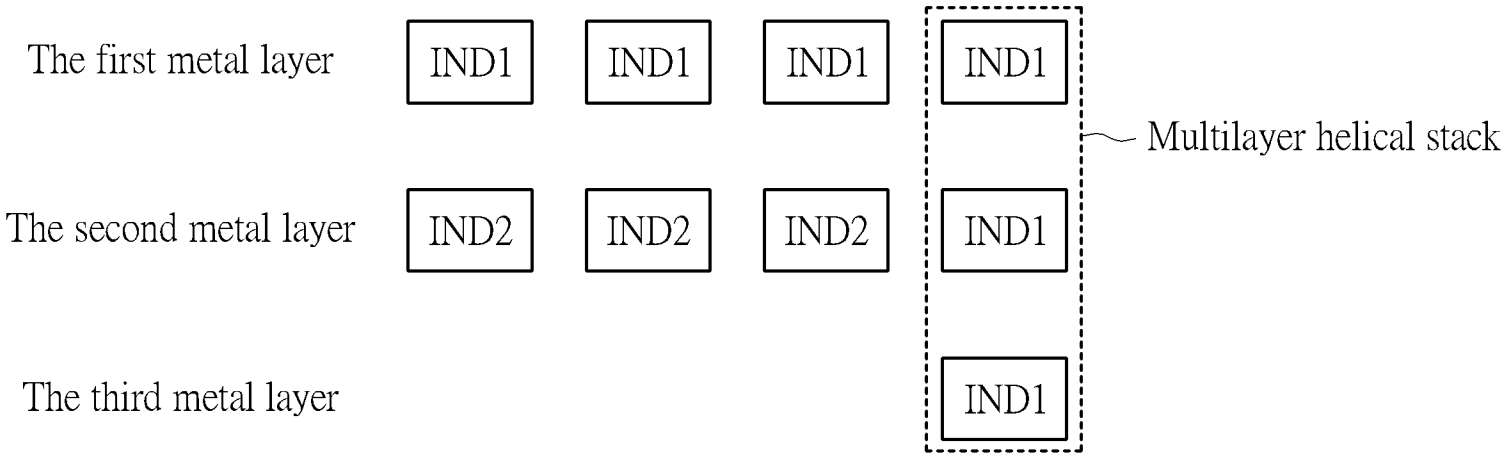
FIG. 3 is a diagram illustrating an integrated transformer according to another embodiment of the present invention.

Refer to FIG. 2A, FIG. 2B, FIG. 2C, FIG. 2D and FIG. 2E, wherein FIG. 2A, FIG. 2B and FIG. 2C are diagrams illustrating patterns of the first metal layer, the second metal layer, the third metal layer and the fourth metal layer of an integrated transformer according to a second embodiment of the present invention, FIG. 2D is a diagram illustrating a top view of the integrated transformer according to the second embodiment of the present invention, and FIG. 2E is a cross-sectional view of this embodiment. The integrated transformer in this embodiment can be applied to be a transformer or a balun in a radio frequency integrated circuit.

In this embodiment, the integrated transformer is an asymmetric integrated transformer, wherein the proportion of the two inductances is 9 nH:6 nH (nano-Henry), and the whole integrated transformer occupies a small area of about 150 um*100 um (micro-meter). This is only an example, and not a limitation of the present invention.

In this embodiment, the first metal layer is a Re-Distribution Layer (RDL), and the second metal layer is an Ultra-Thick Metal (UTM), and the second metal layer is disposed between the first metal layer and the third metal layer, but this is not a limitation of the present invention. In other embodiments, the first metal layer and the second metal layer can be any two adjacent metal layers.

FIG. 2A, FIG. 2B and FIG. 2C illustrate that the integrated transformer is mainly formed by a primary inductor and a second inductor formed by the first metal layer, the second metal layer, the third metal layer and the fourth metal layer, wherein the primary inductor is electrically isolated from the secondary inductor. The pattern of the first metal layer comprises a spiral winding 210 and two via holes 217 and 218, and the spiral winding 210 in this embodiment has 8 or 9 turns; the pattern of the second metal layer comprises two input nodes 221_1 and 221_2 of the primary inductor, two input nodes 222_1 and 222_2 of the secondary inductor, spiral windings 220 and 225 and a plurality of via holes 224_1, 224_2, 226, 227, 228, 229_1 and 229_2; and the third metal layer comprises a spiral winding 230, a plurality of bridges 232 and 233 and a plurality of via holes 234_1, 234_2, 236, 237, 238, 239_1 and 239_2. The fourth metal layer comprises a plurality of bridges 242 and 243 and two center tap windings 245 and 246. The via holes in FIG. 2A, FIG. 2B and FIG. 2C are arranged to electrically connect two different metal layers. For example, the via hole 218 of the first metal layer is electrically connected to the via hole 228 of the second metal layer, and the via hole 229_1 of the second metal layer is electrically connected to the via hole 239_1 of the third metal layer.

In this embodiment, the primary inductor comprises a B turns spiral winding 210 formed by the first metal layer and an A turns spiral winding 220 formed by the second metal layer. In the embodiments of FIG. 2A and FIG. 2B, B is 8 or 9 and A is 1 or 2. More specifically, the two input nodes 221_1 and 221_2 of the primary inductor are both disposed in the second metal layer, and the spiral winding 210 formed by the first metal layer is connected in series with the spiral winding 220 formed by the second metal layer via the via holes 218 and 228 to form the primary inductor.

In this embodiment, the secondary inductor comprises a C turns spiral winding 225 formed by the second metal layer and a P turns spiral winding formed by the third metal layer. In the embodiments of FIG. 2B and FIG. 2C, C is 4 or 5, and P is 2. More specifically, the two input nodes 222_1 and 222_2 of the secondary inductor are both disposed in the second metal layer, the input node 222_2 is directly connected to the spiral winding 225, and the spiral winding 225 formed by the second metal layer is connected in series with the spiral winding 230 formed by the third metal layer via the via holes 229_1 and 239_1. The spiral winding 230 is connected to the bridge 233 and the input node 222_1 via a bridge 243 between the via holes 237 and 238 to form the secondary inductor.

The center tap winding 245 is connected to the center of the windings of the primary inductor via the via holes 234_1, 224_1 and 214, and the center tap winding 245 is arranged to connect to a fixed voltage; for example, connecting to a supply voltage or a ground voltage to make the center of the winding of the primary inductor maintain the fixed voltage. In addition, the center tap winding 246 is connected to the center of the windings of the secondary inductor via the via holes 234_1 and 224_2, and the center tap winding 246 is arranged to connect to a fixed voltage; for example, connecting to a supply voltage or a ground voltage to make the center of the winding of the secondary inductor maintain the fixed voltage.

The top view of FIG. 2D illustrates that, in the primary inductor, the spiral winding 220 formed by the second metal layer and the innermost turn of the spiral winding 210 formed by the first metal layer are substantially overlapped; and in the secondary inductor, the spiral winding 225 formed by the second metal layer and a portion of windings formed by the first metal layer of the primary inductor are substantially overlapped, and the innermost turn of the secondary inductor is directly next to the outermost turn of the spiral winding 220 formed by the second metal layer.

In the cross-sectional view of A-A' of FIG. 2D, illustrated in FIG. 2E, IND1 means the primary inductor, and IND2 means the secondary inductor. In the innermost two turns of the cross-sectional view of A-A', the primary inductor forms a helical stack structure, and the primary inductor and the second inductor form an L-shaped mutual inductance between two inductances. Therefore, the quality factor Q of the integrated transformer can be improved, the coupling quantity can be enhanced and the used area can be reduced. The mutual inductance between the primary inductor and the secondary inductor comprises the vertical coupling, the diagonal coupling and the horizontal coupling in a short distance. In other words, the primary inductor and the secondary inductor form a mutual inductor by the vertical coupling, the diagonal coupling and the horizontal coupling in the short distance.

In the integrated transformers described in the abovementioned embodiment, because the primary inductor and the secondary inductor both use spiral winding formed by two different series metal layers, the primary inductor and the secondary inductor can have maximum inductance with the smallest chip area. In addition, the integrated transformer in this embodiment has good quality factor and coupling quantity, so the manufacturing costs can be reduced while optimizing the element specification.

The designs of part of the integrated transformer depicted in FIG. 2A to FIG. 2E are only an example, and not a limitation of the present invention. More specifically, the spiral windings 220 and 230 do not need to be spiral winding, and the turns of the primary inductor and the secondary inductor can be changed in response to practical requirements. In addition, the spiral winding 230 in FIG. 2C is mainly arranged to provide extra inductance and coupling quantity to the secondary inductor. In another embodiment of the present invention, the spiral winding 230 in FIG. 2C can be removed from the integrated transformer.

Although in the embodiments in FIG. 2A to FIG. 2E the primary inductor and the secondary inductor do not comprise any parallel connection structure, for other reasons such as improving the quality factor, or increasing available space in the integrated transformer, one or more extra metal layers may be used to form a stack structure. For example, the third metal layer or other metal layers may be used to form a plurality of segments to connect with a portion of windings of primary inductor or secondary inductor in parallel. These alternative designs also fall within the scope of this invention.

In addition, in the embodiments of FIG. 1A to FIG. 1D, FIG. 2A to FIG. 2D, the windings of the inductors are all square; however, in other embodiments of the present invention, the windings can be hexagonal, octagonal or even circular. These alternative designs also fall within the scope of this invention.

Figure 4:
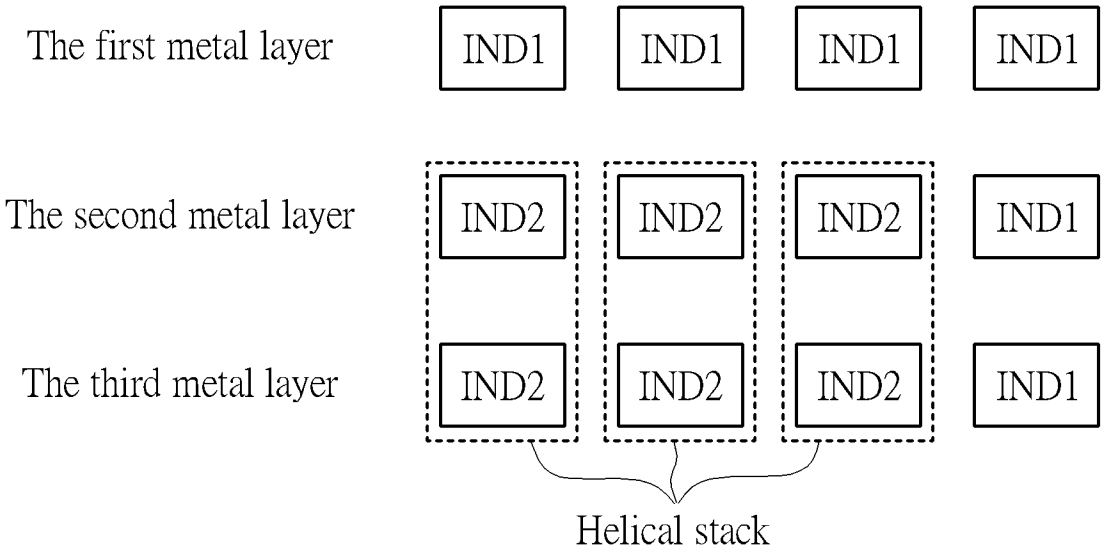
FIG. 4 is a diagram illustrating an integrated transformer according to another embodiment of the present invention.
Figure 5:
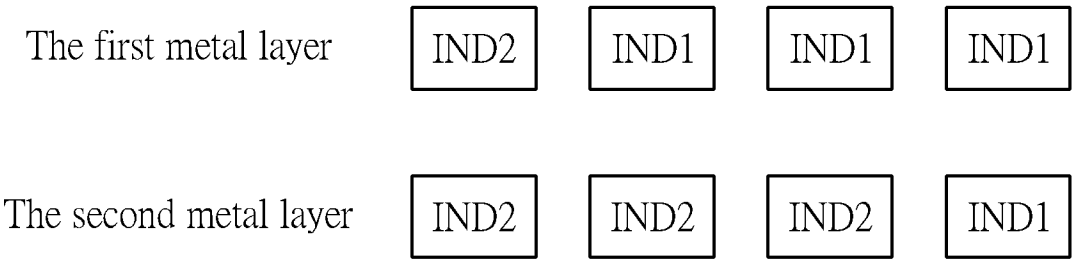
FIG. 5 is a diagram illustrating an integrated transformer according to another embodiment of the present invention.
Figure 6:
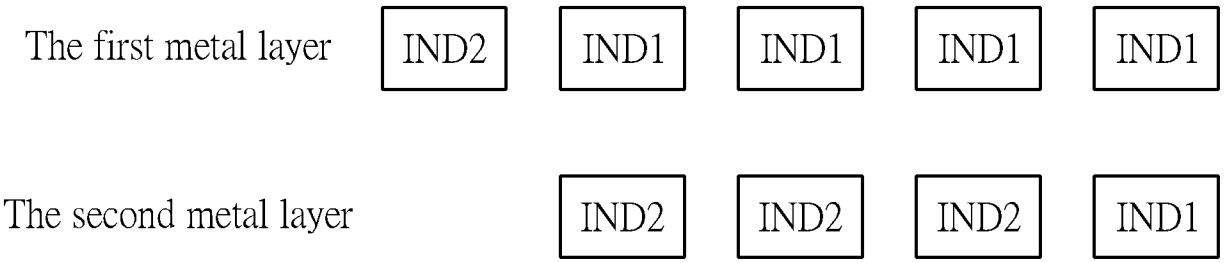
FIG. 6 is a diagram illustrating an integrated transformer according to another embodiment of the present invention.

FIG. 3 to FIG. 6 depict the diagrams illustrating the integrated transformers of other embodiments of the present invention. More specifically, in the embodiment of FIG. 3, the two layers helical stack structure in the inner turns of the primary inductor in FIG. 1E and FIG. 2E is revised to three layers helical stack structure. That is, the primary inductor further comprises a winding formed by the third metal layer, and this winding is connected in series with the spiral windings 110 and 120 as shown in FIG. 1A to FIG. 1E. In the embodiment of FIG. 4, not only is the two layers helical stack structure of the inner turns of the primary inductor in FIG. 1E and FIG. 2E revised to three layers helical stack structure, but the secondary inductor also comprises two layers helical stack structure formed by the second metal layer and the third metal layer. That is, the secondary inductor further comprises a C turns spiral winding formed by the third metal layer, and the C turns spiral winding formed by the second metal layer and the C turns spiral winding formed by the third metal layer of the secondary inductor are substantially overlapped. In the embodiment of FIG. 5, a helical stack structure formed by the first metal layer and the second metal layer of the secondary inductor is added on the outermost turn of the integrated transformer. In the embodiment of FIG. 6, a winding formed by the first metal layer is arranged to connect with the secondary inductor on the outermost turn of the integrated transformer. As one skilled in the art can understand how to implement the embodiments of FIG. 3 to FIG. 6 after reading the description of FIG. 1A to FIG. 1E and FIG. 2A to FIG. 2E, the associated details are omitted here. In addition, the present invention can also use the processing technology of 3-dimensions stack. For example, IND1 is disposed on the first die and IND2 is disposed on the second die.

Briefly summarized, in the integrated transformer of the present invention, the primary inductor uses the spiral winding originating from the first metal layer and the second metal layer to be connected in series, and the secondary inductor at least uses the spiral winding formed by the second metal layer. The primary inductor and the secondary inductor can therefore have the maximum inductances in the smallest area. The integrated transformer in this embodiment has good quality factor and coupling quantity, so manufacturing costs can be reduced and the element specification can be optimized.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated transformer, comprising:

a primary inductor, comprising a B turns spiral winding formed by a first metal layer and an A turns winding formed by a second metal layer, wherein the A turns winding formed by the second metal layer and the innermost turns of the B turns spiral winding are at least partially overlapped; and a secondary inductor, comprising a C turns winding at least formed by the second metal layer, wherein the C turns winding formed by the second metal layer of the secondary inductor and a portion of windings formed by the first metal layer of the primary inductor are at least partially overlapped;

wherein A is less than B, and A is not bigger than C.

2. The integrated transformer of claim 1, wherein the A turns winding formed by the second metal layer is also a spiral winding, and the B turns spiral winding formed by the first metal layer is connected in series with the A turns winding formed by the second metal layer via a via hole to form the primary inductor.

3. The integrated transformer of claim 1, wherein the innermost turn of the windings of the secondary inductor is directly next to the outermost turn of the A turns winding formed by the second metal layer.

4. The integrated transformer of claim 1, wherein the secondary inductor further comprises a plurality of segments formed by a third metal layer, wherein the plurality of segments are arranged to be the bridges of the C turns winding formed by the second metal layer of the secondary inductor, and the second metal layer is disposed between the first metal and the third metal layer.

5. The integrated transformer of claim 1, wherein the secondary inductor further comprises a plurality of segments formed by a third metal layer, wherein the plurality of segments are arranged to connect with a portion of the C turns winding formed by the second metal layer of the secondary inductor in parallel, and the second metal layer is disposed between the first metal layer and the third metal layer.

6. The integrated transformer of claim 1, wherein the secondary inductor further comprises a P turns winding formed by a third metal layer, and the P turns winding formed by the third metal layer of the secondary inductor and a portion of windings formed by the second metal layer of the primary inductor are at least partially overlapped.

7. The integrated transformer of claim 6, wherein the P turns winding formed by the third metal layer of the secondary inductor and the C turns winding formed by the second metal layer of the primary inductor are at least partially overlapped.

8. The integrated transformer of claim 6, wherein the P turns winding formed by the third metal layer is also a spiral winding, and the C turns spiral winding formed by the second metal layer is connected in series with the P turns winding formed by the third metal layer via a via hole to form the secondary inductor.

9. The integrated transformer of claim 1, wherein a center of the primary inductor or a center of the secondary inductor is connected to a center tap, and the center tap is formed by a third metal layer.

10. The integrated transformer of claim 1, Wherein the first metal layer is a Re-Distribution Layer (RDL) and the second metal layer is an Ultra-Thick Metal layer (UTM).

11. The integrated transformer of claim 1, wherein the primary inductor and the secondary inductor form a mutual inductance by a vertical coupling, a diagonal coupling and a horizontal coupling.

12. The integrated transformer of claim 1, wherein the primary inductor further comprises a winding formed by a third metal layer, and the B turns spiral winding formed by the first metal layer, the A turns winding formed by the second metal layer and the winding formed by the third metal layer are connected together in series to form the primary inductor.

13. The integrated transformer of claim 1, wherein the primary inductor further comprises a winding formed by a third metal layer, and the B turns spiral winding formed by the first metal layer, the A turns winding formed by the second metal layer and the winding formed by the third metal layer are connected together in series to form the primary inductor; and the secondary inductor further comprises a C turns spiral winding formed by the third metal layer, and the C turns spiral winding formed by the second metal layer and the C turns spiral winding formed by the third metal layer of the secondary inductor are at least partially overlapped.

14. The integrated transformer of claim 1, wherein the secondary inductor further comprises a winding formed by the first metal layer, and the winding formed by the first metal layer of the secondary inductor is disposed outside the B turns spiral winding formed by the first metal layer of the primary inductor.

* * * * *